US011634300B2

(12) United States Patent
Studer et al.

(10) Patent No.: US 11,634,300 B2
(45) Date of Patent: Apr. 25, 2023

(54) METHOD FOR DETECTING AN ENTRY INTO AN ELEVATOR CAR OF AN ELEVATOR SYSTEM BY A PASSENGER

(71) Applicant: Inventio AG, Hergiswil (CH)

(72) Inventors: Christian Studer, Kriens (CH); Martin Kusserow, Lucerne (CH); Reto Tschuppert, Lucerne (CH); Zack Zhu, Baar (CH)

(73) Assignee: INVENTIO AG, Hergiswil Nw (CH)

( * ) Notice: Subject to any disclaimer, the term of this patent is extended or adjusted under 35 U.S.C. 154(b) by 1078 days.

(21) Appl. No.: 16/330,498

(22) PCT Filed: Sep. 4, 2017

(86) PCT No.: PCT/EP2017/072106
§ 371 (c)(1),
(2) Date: Mar. 5, 2019

(87) PCT Pub. No.: WO2018/050471
PCT Pub. Date: Mar. 22, 2018

(65) Prior Publication Data

US 2019/0193986 A1 Jun. 27, 2019

(30) Foreign Application Priority Data

Sep. 13, 2016 (EP) ..... 16188443

(51) Int. Cl.
*B66B 1/34* (2006.01)
*B66B 5/00* (2006.01)

(52) U.S. Cl.
CPC ..... *B66B 1/3476* (2013.01); *B66B 1/3492* (2013.01); *B66B 5/0012* (2013.01); *B66B 5/0037* (2013.01)

(58) Field of Classification Search
CPC ..... B66B 5/0012; B66B 1/3492; B66B 3/006; B66B 1/3461; B66B 13/22; B66B 5/04; B66B 2201/232; B66B 2201/402; B66B 5/0006; B66B 13/146; B66B 2201/214; B66B 1/14; B66B 2201/212; B66B 1/285; B66B 7/123; B66B 2201/4669; B66B 1/34; B66B 1/3476
See application file for complete search history.

(56) References Cited

U.S. PATENT DOCUMENTS 9,330,202 B2 5/2016 Kan et al.
10,046,947 B2 8/2018 Haipus
(Continued)

FOREIGN PATENT DOCUMENTS

CA 3035433 A1 * 3/2018 ..... B66B 1/3476
CN 101477580 A 7/2009
(Continued)

*Primary Examiner* — Marlon T Fletcher
(74) *Attorney, Agent, or Firm* — William J. Clemens; Shumaker, Loop & Kendrick, LLP

(57) ABSTRACT

A method for detecting an entry into an elevator car of an elevator system by a passenger uses a mobile device carried by the passenger. The mobile device has at least one, but in particular a plurality of sensors, with which the mobile device detects and evaluates measured values. An entry into the elevator car is then detected on the basis of comparing the measured values with at least one stored signal pattern.

6 Claims, 3 Drawing Sheets

(56) References Cited

U.S. PATENT DOCUMENTS

| | | | | |
|---|---|---|---|---|
| 10,113,869 | B2 | 10/2018 | Sasaki | |
| 2013/0332064 | A1 | 12/2013 | Funk et al. | |
| 2014/0330535 | A1 | 11/2014 | Van Den Heuvel et al. | |
| 2014/0365119 | A1 | 12/2014 | Haverinen et al. | |
| 2015/0070131 | A1 | 3/2015 | Beaurepaire et al. | |
| 2015/0284214 | A1 | 10/2015 | Park et al. | |
| 2016/0130114 | A1 | 5/2016 | Wilke et al. | |
| 2017/0089704 | A1 | 3/2017 | Takaoka et al. | |
| 2019/0193992 | A1 | 6/2019 | Studer et al. | |
| 2020/0002124 | A1* | 1/2020 | Wirola | B66B 1/468 |
| 2021/0395038 | A1* | 12/2021 | Wong | B66B 1/468 |

FOREIGN PATENT DOCUMENTS

| | | | | | |
|---|---|---|---|---|---|
| CN | 102009883 | A | | 4/2011 | |
| CN | 103025239 | A | | 4/2013 | |
| CN | 103193118 | A | | 7/2013 | |
| CN | 103787159 | A | | 5/2014 | |
| CN | 104071664 | A | | 10/2014 | |
| CN | 104145172 | A | * | 11/2014 | B66B 1/3492 |
| CN | 104444658 | B | | 3/2015 | |
| CN | 104864873 | A | | 8/2015 | |
| CN | 105209364 | A | | 12/2015 | |
| CN | 105247320 | A | | 1/2016 | |
| CN | 105967025 | A | | 9/2016 | |
| CN | 109689551 | A | * | 4/2019 | B66B 1/3476 |
| JP | 2017024858 | A | * | 2/2017 | B66B 1/14 |
| WO | WO-2013084154 | A2 | * | 6/2013 | B66B 1/3492 |
| WO | 2013130040 | A1 | | 9/2013 | |
| WO | 2015182304 | A1 | | 12/2015 | |
| WO | 2017175019 | A1 | | 10/2017 | |
| WO | WO-2018050470 | A1 | * | 3/2018 | B66B 5/0025 |
| WO | WO-2018050471 | A | * | 3/2018 | B66B 1/3476 |
| WO | WO-2019076917 | A1 | * | 4/2019 | B66B 5/0012 |

* cited by examiner

METHOD FOR DETECTING AN ENTRY INTO AN ELEVATOR CAR OF AN ELEVATOR SYSTEM BY A PASSENGER

FIELD

The invention relates to a method for detecting an entry into an elevator car of an elevator system by a passenger.

BACKGROUND

WO 2013/130040 A1 describes a method for monitoring a use of an elevator system. In this method, the passengers of the elevator system are equipped with marking devices, known as tags. Reading devices are attached to shaft doors or, in elevators, cars of the elevator system that can recognize whether a tag is in its vicinity and, if so, which one. It can thus also be recognized if a passenger enters an elevator car. The reading device forwards the information to a traffic analysis unit that can monitor the use of the elevator system on the basis of this information or can record it for a later analysis. The method according to WO 2013/130040 A1 thus needs one tag per passenger and at least one reading device per shaft door or per elevator car.

US 201/4330535 A1 describes a method for detecting the movement of a passenger in an elevator car. According to the method, a series of acceleration measurements is evaluated in order to detect a beginning and an end of a trip of the elevator car. The method, however, is not suitable for detecting an entry into an elevator car by a passenger.

By contrast, it is, in particular, an object of the invention to propose a method, by means of which an entry into an elevator car by a passenger may be detected with as little additional hardware as possible and thus as cost-efficiently as possible.

SUMMARY

In the method according to the invention for detecting an entry into an elevator car of an elevator system by a passenger, it is assumed that the passenger carries a mobile device with him. The mobile device has at least one, but especially a plurality of sensors, by which the mobile device detects and evaluates measured values. An entry into the elevator car is then detected on the basis of said measured values.

Under a "detection of an entry into an elevator car of an elevator system by a passenger," it is understood that the instant of the entry into the elevator car is detected. The entry into the elevator car and thus the instant of the entry temporally precedes a trip of the passenger in an elevator car or a movement and thus an acceleration of the passenger and of the elevator car in the vertical direction. The instant of the entry into the elevator car cannot be determined from the detection of a movement or acceleration of the passenger and of the elevator car in the vertical direction. The timespan between entry into the elevator car and the start of a passenger's trip in the elevator car may be a few seconds or several minutes.

In this day and age, many people and, thus, also many passengers of an elevator system carry with them a mobile device having sensors, for example in the form of a mobile phone or a smartphone. By using these terminal devices, which people carry with them anyway, no additional hardware that would be required just for implementing the method is necessary in order to carry out the method. Additional hardware may be necessary, at most, if the information about an entry into an elevator car generated by the method according to the invention is to be further evaluated. The method according to the invention can thus be executed in a cost-effective manner.

The information that a passenger with a mobile device enters an elevator car may be evaluated in a large variety of ways or further used, for example to trigger a large variety of actions. The terminal device may, for example, forward the information wirelessly to a traffic analysis unit, which can then analyze a traffic flow in the elevator system in a manner comparable to the traffic analysis unit in WO 2013/130040 A1. The mobile device may, for example, be put into a specific mode, for example started in a specific program, an app, or the app put into a predetermined state. For example, an app can be started that displays certain content, or a game can be started that enables playing together with other passengers in the elevator car. Moreover, it is possible for the terminal device, using its sensors, to record measured values during the upcoming trip that are to be evaluated for monitoring the elevator system. As soon as an entry into an elevator car is recognized, the terminal device may be placed in a measuring mode and be made available for a measurement.

In an analogous manner, a departure from an elevator car may be recognized. The exit basically proceeds in reverse from the entry.

The evaluation of the detected data and, thus, the detection of an entry into the elevator car is carried out in particular by the mobile terminal device. However, it is also possible that the detected data are forwarded to an evaluation device, and the detection of an entry into the elevator car is carried out by the evaluation device. In this case, the evaluation of the data by the terminal device is limited to the forwarding of the data to the evaluation device. In addition, it is also possible that at least a part of the evaluation is carried out by the mobile device as well as by the evaluation device. A mutual control and/or supplementation is thus possible, which enables a very high hit probability for the detection of an entry into an elevator car.

The mobile device may, for example, be designed as a mobile telephone, a smartphone, a tablet computer, a smartwatch, what is termed a wearable in the form of an electronic, smart textile, for example, or any other portable terminal device. The sensor of the mobile device may, for example, be designed as a microphone, an accelerometer, a rotational speed sensor, a magnetic field sensor, a camera, a barometer, a brightness sensor, a relative humidity sensor or a carbon dioxide sensor. The accelerometer, rotational speed sensor and magnetic field sensor are designed in particular as what are termed three-dimensional or 3D sensors. Sensors of this type deliver measured values in the x, y and z directions, wherein the x, y and z directions are arranged perpendicular to each other. The terminal device features, in particular, a plurality of sensors and specifically different types of sensors, thus, for example, a microphone, a three-dimensional accelerometer, a three-dimensional rotational speed sensor and a three-dimensional magnetic field sensor. In the following, accelerometers, rotational speed sensors and magnetic field sensors are understood to be three-dimensional accelerometers, rotational speed sensors and magnetic field sensors.

The passenger can bring the terminal device with him in completely different orientations so that it is not initially clear how the accelerometers, rotational speed sensors or magnetic field sensors are oriented in space. However, because the gravitational acceleration is always measured, it may be used to uniquely determine the vertical direction, that is the absolute z direction, at least if the passenger does not move. With the knowledge of the absolute z direction, the measured values of the accelerometers, rotational speed sensors and magnetic field sensors may be converted into values that are oriented along the absolute z direction and absolute x and y directions. The absolute x, y and z directions are thus each arranged perpendicular to each other. All of the following statements on accelerations, rotational speeds or magnetic field strengths relate to measured values and statements about x, y and z directions converted in this manner to absolute x, y and z directions. Instead of the determination of the values in the absolute x, y and z directions, the three measured values may be treated as vectors and a resulting vector may be formed from the individual vectors. Instead of using the three individual vectors, the resulting vector may also be used.

In an embodiment of the invention, the mobile terminal device, using the sensor or sensors, detects measured values characterizing movements of the passengers and evaluates these values. The indicated measured values are, in particular, accelerations, meaning transverse accelerations or rotational speeds, wherein three accelerations and/or rotational speeds are each specifically measured in the x, y and z directions. From the values characterizing movements of the passengers, the movements of the passengers may be determined, and from the movements of the passengers it may be recognized that the passenger has entered an elevator car. It is generally assumed here that the passenger carries the terminal device with him in such a way that the measured values measured by the terminal device indicate not only the movements of the terminal device, but also those of the passenger.

In an embodiment of the invention, a movement pattern of the passenger may be derived and compared to at least one stored signal pattern. The detection of an entry into the elevator car is then performed on the basis of said comparison. Thus, an entry into an elevator car may be detected in an especially reliable manner.

The indicated stored signal patterns are, in this case, movement patterns. In this context, a pattern of movement is understood to include, for example, a temporal sequence, in particular of accelerations or rotational speeds. A pattern of movement may also be described using what is termed here an attribute or, in particular, a plurality of attributes. Attributes of this type may be, for example, statistical parameters, such as averages, standard deviations, minimum/maximum values or results of a Fast Fourier analysis of the indicated accelerations or rotational speeds. A pattern of movement in this case may also be described as what is termed an attribute vector. The aforementioned attributes may be determined in particular for individual time segments, wherein are formed in particular based on values or characteristics of individual measured values. For example, a time segment of this type may be characterized by the passenger not moving and, therefore, must be waiting in front of the shaft door. In particular, not just a single acceleration or rotational speed is considered, but the combination of a plurality of accelerations and/or rotational speeds, specifically of each of three accelerations and rotational speeds.

A stored signal pattern may contain, for example, characteristic properties of accelerations, rotational speeds and/or magnetic fields or attributes when a person is walking to a shaft door, waiting in front of the shaft door until the elevator car is available and entry is possible, entering into the elevator car and turning around in the direction of the car door. The signal patterns may be generated by specialists based on their experience or be determined in particular by one or more tests. Methods of what is termed machine learning are in particular used for recognition or classification of patterns of movement. For example, what is termed a support vector machine, a random forest algorithm or a deep-learning algorithm may be used. These classification methods must first be trained. To do this, typical patterns of movement for entry into an elevator car were created in experiments, in particular based on the aforementioned attributes, and the indicated algorithms were made available for training. After the algorithms have been trained with a sufficient number of training patterns, they can decide whether an unknown pattern of movement characterizes an entry into an elevator car or not. In this case, the signal pattern is stored in the parameters of the algorithm.

The creation of a typical pattern of movement for training may be carried out by a passenger who uses the mobile device in daily use. He only needs to indicate the beginning and the end of the entry into an elevator car. It is also possible that, after the conclusion of the actual training, the passenger gives feedback as to whether an entry into the elevator car was not recognized or erroneously recognized. This feedback may be used for further training of the algorithm.

Because not all people move in the same way, for example, they turn around at different speeds, and, for example, waiting times are of different lengths, the measured pattern of movement is in particular compared not just to one signal pattern, but to a whole array of slightly different signal patterns.

In an embodiment of the invention, the mobile device detects measured values characterizing activities of the elevator system using a or the sensor(s) and evaluates these. Activities of the elevator system should be understood to include, for example, movements of individual components of the elevator system, such as movements of the elevator car, a shaft door, a car door or an activation of a door drive. In particular, the terminal device detects noises and/or magnetic fields, wherein specifically three magnetic fields are measured in the x, y and z directions. The changes of the measured magnetic fields may, for example, be caused by the activity of a door drive having an electric motor and/or by the car and/or shaft door having ferromagnetic magnetic material. It may be concluded from the indicated measured values, for example, that the car door has opened in front of a passenger and closed behind him.

In an embodiment of the invention, an activity pattern of the elevator system is derived from the measured values and compared to at least one stored signal pattern. The detection of an entry into the elevator car is then performed on the basis of said comparison. Thus, an entry into an elevator car may be detected in an especially reliable manner.

The stored signal patterns mentioned in this case relate to activity patterns. In this context, a temporal sequence, in particular of measured noises and/or magnetic fields, is to be understood under activity pattern. An activity pattern may also be described using an attribute or, specifically, a plurality of attributes described in connection with patterns of movement. In particular, a single measurement of a magnetic field is considered not only in one direction, but in combination with a plurality of measurements of magnetic fields in a plurality of—in particular, three—directions.

A signal pattern may, for example, describe a noise of a car door during opening or a noise during an entry into the elevator car at a floor or attributes derived therefrom. The signal patterns may be generated by specialists based on their experience or be determined in particular by one or more tests. Analogously to the description above, methods of what is termed machine learning in combination with patterns of movement may in particular be applied to determine the signal pattern. The signal pattern may likewise be divided into time segments and individual attributes determined for each segment.

Because similar activities of elevators, such as the opening of a car door, may vary—they may take different lengths of time, for example—the measured activity pattern is specifically compared not just to one signal pattern, but to a whole array of slightly different signal patterns.

In an embodiment of the invention, the mobile device uses the sensor to detect measured values characterizing properties of the environment of the mobile device and evaluates them. For example, magnetic fields, the air pressure, the brightness, the relative humidity or a carbon dioxide content of the air can be measured.

In an embodiment of the invention, a characteristic pattern of the elevator system is derived from the measured values and compared to at least one stored signal pattern. The detection of an entry into the elevator car is then performed on the basis of said comparison. Thus, an entry into an elevator car may be detected in an especially reliable manner.

The stored signal patterns mentioned in this case are characteristic patterns. A characteristic pattern in this context should be understood to include, for example, a temporal sequence of measured values that describes the environment of the terminal device, thus, in this case properties of the elevator system. A characteristic pattern may also be described with an attribute or, in particular, a plurality of attributes described in connection with patterns of movement. In particular, not just the characteristic of a single measurement of one of the aforementioned characteristics is considered, but the combination of a plurality of measurements.

A signal pattern may, for example, describe the change of the magnetic field from the outside to the inside of the elevator car or attributes derived therefrom. Changes of the magnetic field may, for example, be caused by the different use of ferromagnetic materials of various electrical components, such as coils outside and inside the elevator car. The ferromagnetic materials may themselves create a magnetic field and/or influence the earth's magnetic field.

A signal pattern may, for example, describe the change of the CO2 content of the air from the outside to the inside of the elevator cabin or attributes derived therefrom. The CO2 content of the air increases because of the air exhaled by the passengers in the closed elevator car. The CO2 content of the air in the car is thus generally higher than outside. In addition, the CO2 content slowly increases during the trip, whereby a trip in an elevator car may be detected. Although this increase is a rather slow process, it may be detected in longer trips.

A signal pattern may, for example, describe the change in the relative humidity from the outside to the inside of the elevator car or attributes derived therefrom. This slowly increases analogously to the CO2 content inside the car because of the exhaled air, so that the evaluation may be performed analogously to the CO2 content.

A signal pattern may, for example, describe the change in the temperature from the outside to the inside of the elevator car or attributes derived therefrom. The temperature increases slowly because of the heat emitted by the passengers, so that the evaluation may be performed analogously to the CO2 content.

A signal pattern may, for example, describe the change in the brightness from the outside to the inside of the elevator car or attributes derived therefrom. Inside an elevator car, it is generally less bright than outside.

A signal pattern may, for example, describe the change in the acoustics from the outside to the inside of the elevator car or attributes derived therefrom. Because an elevator car is a comparatively narrow, closed space, the echo or the sound damping changes, for example. Specialized test signals, for example, may be used to determine this change.

The signal patterns may be generated by specialists based on their experience or be determined in particular by one or more tests. Analogously to the above description, methods of what is known as "machine learning" may be used in connection with movement patterns to determine the signal pattern. The signal patterns may also be divided into time gates, and individual attributes may be specified for each segment.

Because not all elevator systems have identical characteristic patterns, but instead they may vary, the measured characteristic pattern is compared not just to one signal pattern, but to a whole array of slightly different signal patterns.

For the detection of an entry into an elevator car, it is not just measured values characterizing individual movements of the passengers, measured values characterizing activities of the elevator system or measured values characterizing the properties of the elevator system that are detected and evaluated, but a combination of these different types of measured values. Thus, an entry into an elevator car may be detected in an especially reliable manner.

In an embodiment of the invention, at least one of the named stored signal patterns is changed; in particular, all stored signal patterns are changed. A learning process therefore takes place, by means of which the stored signal patterns keep getting better adapted to the actual events. With this, an especially precise detection of an entry into an elevator car by a passenger is possible.

In particular, a trip in an elevator car is detected from the measured values measured by at least one of the sensors of the mobile terminal device. As soon as a trip in an elevator car has been detected, patterns of movement, activity and/or characteristics detected before the trip are compared to stored signal patterns, and the stored signal patterns are adjusted based on the comparison. In particular, the stored signal patterns are modified in the direction of the movement of the activity and/or characteristic patterns detected before the trip. In particular, this enables the method of what is termed machine learning described above to be implemented. A particularly effective learning and, thus, also a particularly precise detection of an entry into an elevator car by a passenger is possible.

If a trip in an elevator car has been detected, an exit from the elevator car may also be detected with a very high hit probability. As soon as the passenger travels transverse to the vertical direction, that is, moves significantly either in x and/or y direction, an exit from the elevator car may be assumed. This movement may, for example, be detected via the acceleration sensor. Alternatively to the detection of a movement in the x/y direction, the resulting vector of the accelerations in the x, y and z directions described above may also be used.

A trip of an elevator car has a characteristic trend of acceleration in the vertical direction. The elevator car is first accelerated upward or downward, then usually travels for a while at a constant speed and is then braked to a standstill. This acceleration characteristic may be recognized with great accuracy in the measured values of one or a plurality of acceleration sensors of the mobile terminal device. In this way, a reliable detection of a trip of a passenger and thus of the mobile device in an elevator car is possible. On the basis of this reliable detection, a reliable adaptation of the stored signal patterns is possible, ultimately leading to a particularly reliable detection of a passenger entering an elevator car.

Alternatively or additionally, the air pressure measured by a barometer may also be evaluated in order to detect a trip in an elevator car. A change in the air pressure is caused by the trip in the vertical direction, wherein the gradient of the change is significantly larger in magnitude than in the case of climbing stairs or weather-related changes of the air pressure.

Additional advantages, features and details of the invention are provided in the following description of exemplary embodiments as well as in the drawings, in which the same or functionally equivalent elements are provided with identical reference characters.

DETAILED DESCRIPTION

Figure 1:
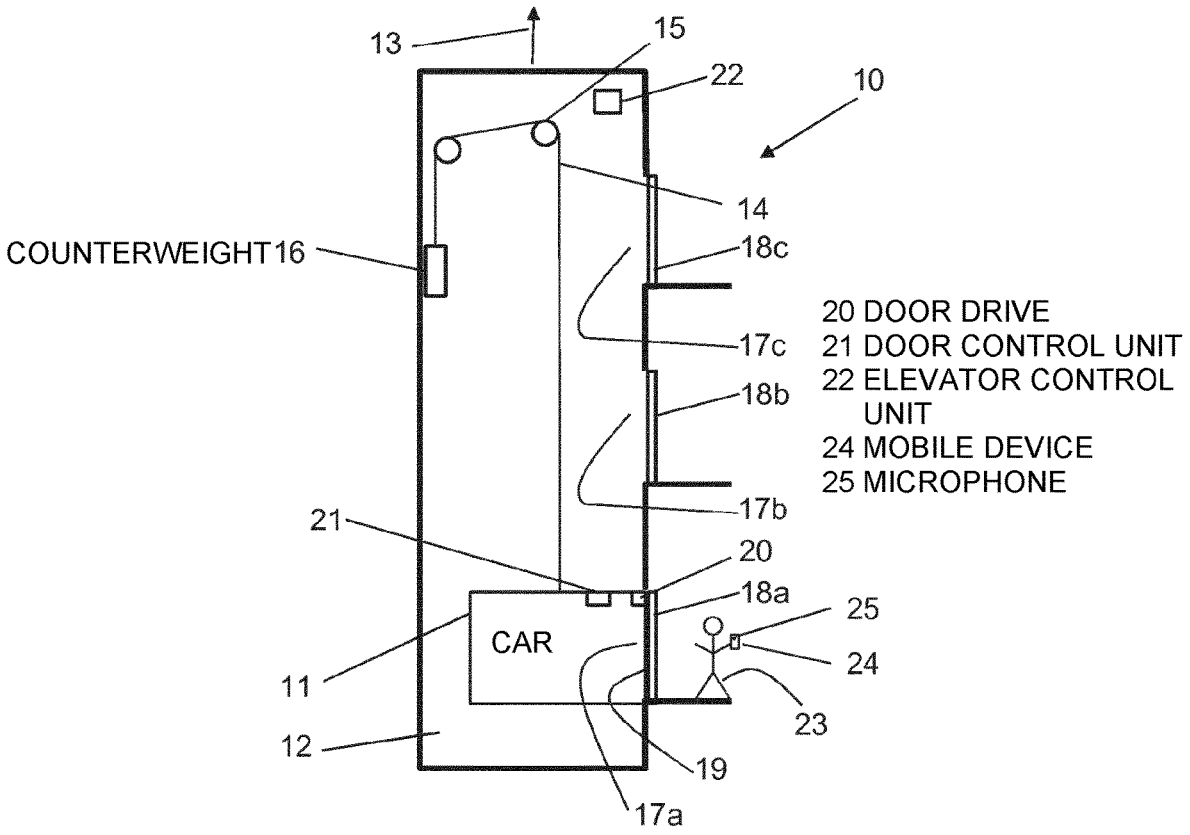
FIG. 1 is a schematic representation of an elevator system with one passenger.

According to FIG. 1, an elevator system 10 features an elevator car 11 that can move up and down in the vertical direction 13 within an elevator shaft 12. For this purpose, the elevator car 11 is connected to a counterweight 16 via a flexible suspension means 14 and a drive pulley 15 of a drive, not described in further detail. The drive can move the elevator car 11 and the counterweight 16 up and down in opposite directions via the drive pulley 15 and the suspension means 14. The elevator shaft 12 has three shaft openings 17*a*, 17*b*, 17*c* and thus three floors that are closed with shaft doors 18*a*, 18*b*, 18*c*. In FIG. 1 the elevator car 11 is located at the shaft opening 17*a*, thus on the lowest floor. If the elevator car 11 is located at a floor, meaning at one of the shaft openings 17*a*, 17*b*, 17*c*, the corresponding shaft door 18*a*, 18*b*, 18*c* together with a car door 19 may be opened and the entry into the elevator car 11 thereby made possible. To open the car door 19 and the corresponding shaft door 18*a*, 18*b*, 18*c*, door segments, not further described, are pushed laterally, so that there is a displacement of the door segments. The car door 19 and the corresponding shaft door 18*a*, 18*b*, 18*c* are actuated by a door drive 20 that is controlled by a door control unit 21. The door control unit 21 is in signal connection with an elevator control unit 22 that controls the whole elevator system 10. The elevator control unit 22 controls the drive, for example, and, thus, can move the elevator car 11 to a desired floor. It can, for example, also transmit a request to the door control unit 21 to open the car door 19 and the corresponding shaft door 18*a*, 18*b*, 18*c* that the door control unit 21 then executes via a corresponding control of the door drive 20.

A passenger 23 who carries with him a mobile device in the form of a mobile telephone 24 stands at the lowest floor, thus in front of the shaft door 18*a*. The mobile telephone 24 features a plurality of sensors, of which only a microphone 25 is illustrated. The mobile telephone 24 also has three-dimensional acceleration, rotational speed and magnetic field sensors that can detect measured values in the x, y and z directions. As explained above, the measured values detected by the acceleration, rotational speed and magnetic field sensors may be easily converted into values related to the absolute x, y and z directions. All of the following statements on acceleration, rotational speed or magnetic field strength are thus based on measured values and statements about the x, y and z directions converted in this manner to the absolute x, y and z directions.

Measured values detected on the basis of sensors of the mobile telephone 24 are recognized if the passenger 23 enters the elevator car 11. The mobile telephone 24 continuously detects measured values for this purpose and evaluates them. The mobile telephone 24 detects, for example, the rotational speeds about the x, y and z axes. These measured rotational speeds characterize not only movements of the mobile telephone 24, but also movements of the passenger 23. Measured values are detected continuously, and an ongoing movement pattern of the passenger 23 is created from a combination of the individual measured values of the different acceleration sensors. The measured values are thereby filtered, specifically by a low-pass filter. The indicated movement pattern thus contains in this case the characteristics of the rotational speeds about the x, y and z axes. The mobile telephone 24 compares the ongoing movement pattern thus created to stored signal patterns that are typical for a movement pattern during an entry into an elevator car 11. In order to be able to carry out the comparison, attributes in the form of averages, standard deviations and minimum/maximum values of the individual rotational speeds or time segments of the rotational speeds are specified and compared to stored values. If the differences between the attributes of the measured characteristics and the stored attributes are smaller than determinable threshold values, a sufficient match of a movement pattern with a stored signal pattern is recognized. The mobile telephone 24 concludes from this that the passenger 23 has entered the elevator car 11. The mobile telephone 24 can evaluate this information in many different ways. In this example, it switches into a measuring mode, wherein for measurements during the upcoming trip in the elevator car 11 it is ready for monitoring the elevator system 10. The measurements are thus only started at a later instant.

The comparison between a measured movement pattern and a stored signal pattern and thus the recognition or classification of movement patterns can also be carried out using methods of what is termed machine learning. For example, what is termed a support vector machine, a random forest algorithm or a deep-learning algorithm may be used.

The transverse accelerations in the x, y and z directions may also be taken into account, so that the movement pattern also contains the characteristics of the accelerations in the x, y and z directions.

It is also possible that the mobile telephone does not just perform the detection of an entry into an elevator car to the exclusion of anything else, but also transmits the detected data to an evaluation unit. The detection of an entry into the elevator car is then carried out by the evaluation unit. As soon as an entry is recognized, the evaluation unit sends a corresponding signal to the mobile telephone.

Figure 2A:
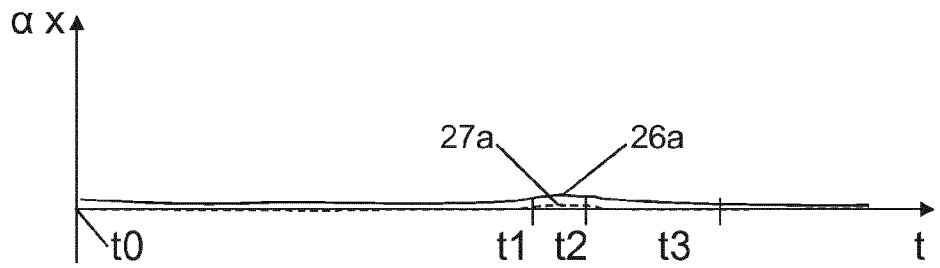
FIGS. 2*a*, 2*b*, 2*c* show time characteristics of rotational speeds during the entry of a passenger into an elevator car.
Figure 2B:
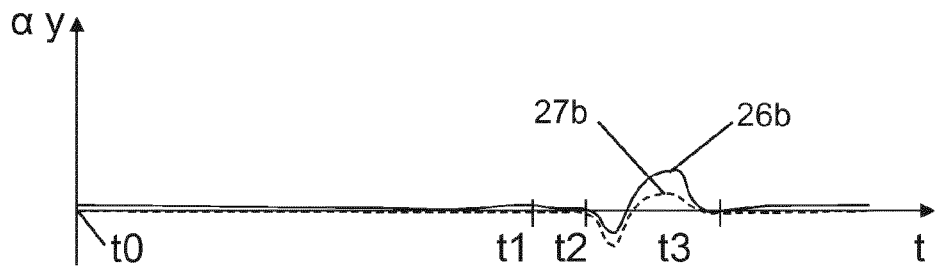
Figure 2C:
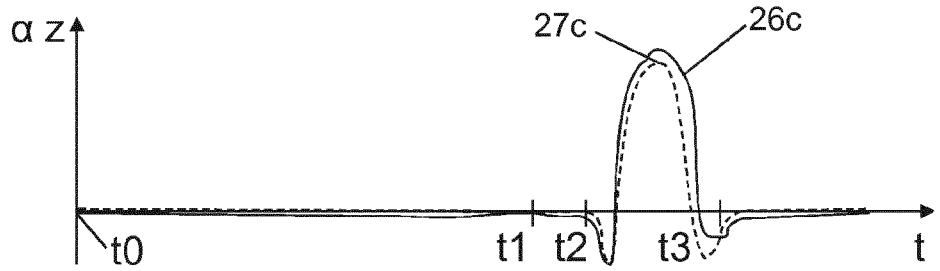

In FIGS. 2*a*, 2*b* and 2*c*, a measured movement pattern and a stored signal pattern over time are shown, wherein in FIG. 2*a* the rotational speeds a about the x axis, in FIG. 2*b* about the y axis and in FIG. 2*c* about the z axis are shown. The measured rotational speeds are each represented by a solid line, and the stored rotational speeds of the signal pattern are each represented by a dashed line. The solid lines 26*a*, 26*b*, 26*c* thus represent the measured rotational speeds and the dashed lines 27*a*, 27*b*, 27*c* represent the stored rotational speeds about the x, y and z axes. The measured values are shown after smoothing.

The stored signal pattern (dashed lines 27*a*, 27*b*, 27*c*) contains typical characteristics of rotational speeds as they appear during an entry into an elevator car. From instant t0 to instant t1, the passenger approaches the shaft door, in order to stop at instant t1 and to wait for the opening of the shaft and car doors at instant t2. Virtually no rotational speeds appear in this. After instant t2, the passenger enters the elevator car and then turns around in the direction of the car door. This reversal first of all results in a significant deflection of the rotational speed about the z axis (line 27*c*), wherein a brief undershooting in the opposite direction occurs at the beginning and at the end of the deflection. As is evident from FIGS. 2*a*, 2*b* and 2*c*, the measured movement pattern (solid lines 26*a*, 26*b*, 26*c*) follows the stored signal pattern quite closely. The comparison of the movement pattern to stored signal patterns proceeds as described above. Based on this correspondence, the mobile telephone concludes that the passenger has entered the elevator car.

Because not all people move in the same way, for example, they turn around at different speeds, and, for example, waiting times are of different lengths, the measured pattern of movement is in particular compared not just to one signal pattern, but to a whole array of slightly different signal patterns.

Complementary to the rotational speeds, the accelerations in the x, y and z directions may also be considered in a comparable manner. Running in the direction of the shaft door and into the elevator car, as well as the waiting in front of and in the elevator car can thus be more easily identified.

In order to make the detection of the entry into an elevator car more reliable, additional measured values detected by sensors of the mobile telephone, in particular, are evaluated. The mobile telephone 24 detects the magnetic field strengths in the x, y and z directions, in particular using the three-dimensional magnetic field sensor. The measured values thus characterize a property of the elevator system. It is very difficult to conclude from measured values at a single instant that the mobile telephone and, thus, the passenger is located in an elevator car. For this reason, a characteristic pattern is created from the time characteristics of the three field strengths, wherein the measured values are filtered, in particular via a low-pass filter. The mobile telephone 24 compares the ongoing characteristic pattern thus created to stored signal patterns that are typical for a movement pattern during an entry into an elevator car 11. If a sufficient correspondence of a movement pattern to a stored signal pattern is detected, the mobile telephone 24 concludes that the passenger 23 has entered the elevator car 11. The comparison of the movement pattern to stored signal patterns proceeds as described above.

Figure 3A:
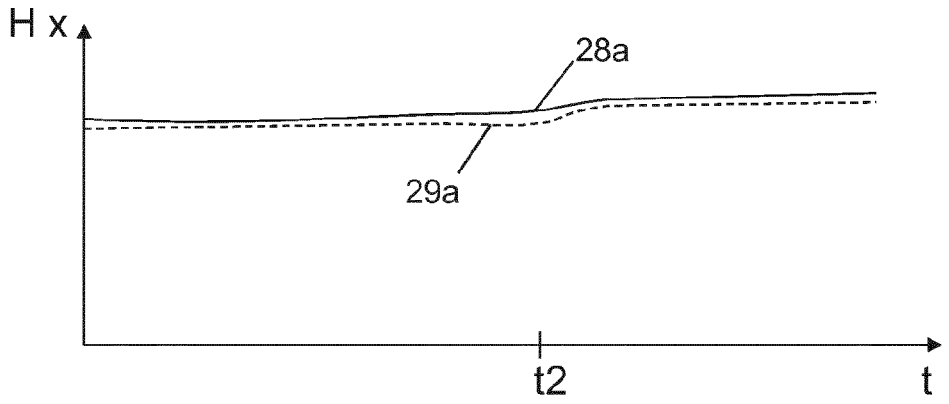
FIGS. 3*a*, 3*b*, 3*c* show time characteristics of magnetic field strengths during the entry of a passenger into an elevator car.
Figure 3B:
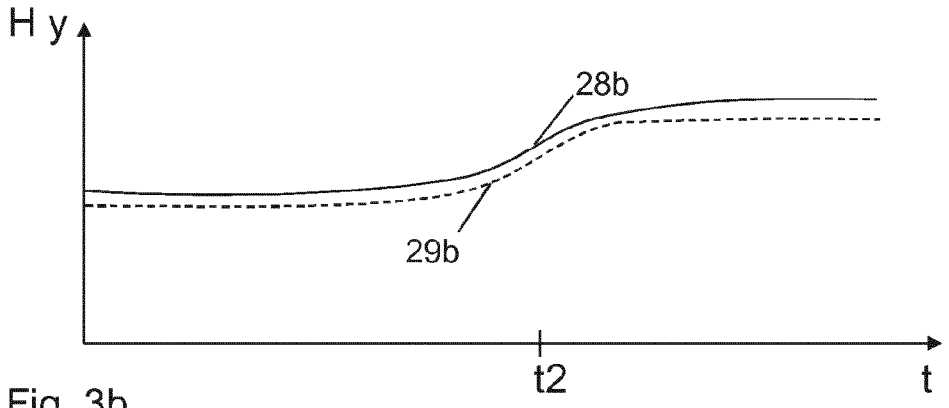
Figure 3C:
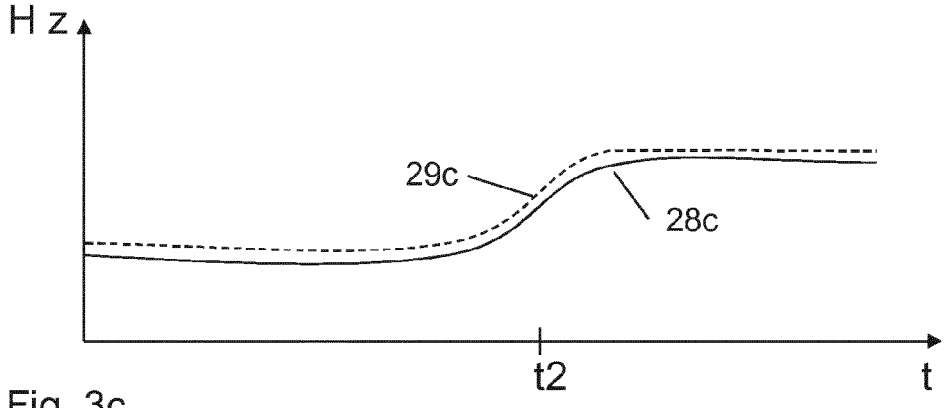

In FIGS. 3*a*, 3*b* and 3*c*, a measured characteristic pattern and a stored signal pattern over time are described, wherein in FIG. 3*a* the magnetic field strength H is shown in the x direction, in FIG. 3*b* it is shown in the y direction and in FIG. 3*c* it is shown in the z direction. The measured field strengths are each represented by a solid line and the stored field strengths of the signal pattern are each represented by a dashed line. The solid lines 28*a*, 28*b*, 28*c* thus represent the measured field strengths and the dashed lines 29*a*, 29*b*, 29*c* the stored field strengths in the x, y and z directions. The measured values are shown after smoothing.

The stored signal pattern (dashed lines 29*a*, 29*b*, 29*c*) contains typical characteristics of field strengths as they appear during an entry into an elevator car. A significant increase in the field strengths in the y and z directions can be seen from shortly before to shortly after instant t2, at which point the passenger enters the elevator car, whereas the field strengths in the x direction remain almost unchanged the whole time. The change in the field strengths is specifically attributable to the use of ferromagnetic materials in the elevator car. As is evident from FIGS. 3*a*, 3*b* and 3*c*, the measured characteristic pattern (solid lines 28*a*, 28*b*, 28*c*) follows the stored signal pattern quite closely. For the mobile telephone, this match is a further indication that the passenger has entered the elevator car. The comparison of the characteristic pattern to the stored signal pattern runs analogously to the comparison of the movement pattern with the stored signal pattern described above.

Because not all elevator systems have identical characteristic patterns, but instead they may vary, the measured characteristic pattern is compared not just to one signal pattern, but to a whole array of slightly different signal patterns.

Furthermore, additional further measured values, such as the air pressure, the brightness, the relative humidity or a carbon dioxide content of the air may be considered.

A further increase in the reliability of the detection of an entry into an elevator car, which also considers measured values that characterize an activity of the elevator system, can thereby be achieved. For example, an activity pattern may be derived from the magnetic field strengths described above that is compared to a signal pattern that is typical for the opening of the car and shaft doors. Another possibility is to derive an activity pattern from noises measured using the microphone and to compare this to the signal pattern that is typical for the opening of the car and shaft doors. As with the movement and characteristic patterns, it may be useful to compare the activity pattern to a plurality of slightly different signal patterns. An adequate match between the measured activity patterns and a stored signal pattern may in turn be evaluated as an indication that the passenger has entered into an elevator car.

The mobile telephone may be designed in such a way that it already detects an entry into an elevator car if there is a single adequate match of a movement pattern, a characteristic pattern or an activity pattern with a stored signal pattern. It is also possible, however, that an entry is only detected if there are at least two, three or more matches.

Figure 4:
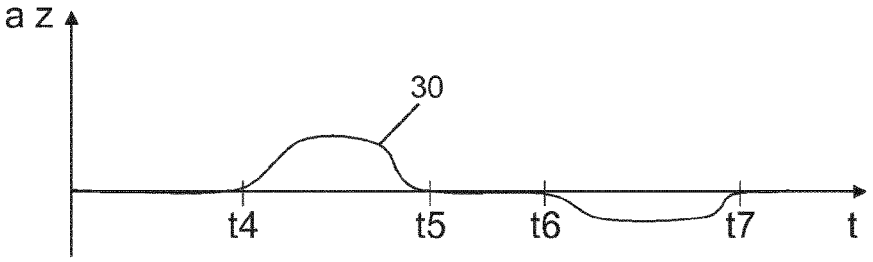
FIG. 4 shows a time characteristic of an acceleration in the vertical direction during a trip of an elevator car.

In order to make a detection of an entry into an elevator car more reliable, the stored signal pattern may be adjusted. Using an adjustment, the method can be specifically adapted to the behavior of the owner of the mobile telephone. To do this, the mobile telephone detects, in particular, a trip in an elevator car. This can be very reliably detected by monitoring the acceleration in the z direction and thus in the vertical direction 13. In FIG. 4, for example, a characteristic of the acceleration "a" upward in the z direction is represented by the line 30, wherein the gravitational acceleration is disregarded. The elevator car 11, and thus also the passenger 23 with his mobile telephone 24, are accelerated from the instant t4 with an almost constant acceleration. Shortly before the desired speed of the elevator car 11 is reached, the acceleration decreases in order to reach the zero line at instant t5. The elevator car 11 then travels at constant speed until instant t6 in order to then brake with a nearly constant negative acceleration until instant t7. This typical characteristic with acceleration in the vertical direction, constant travel and braking to a standstill can be easily detected in the measured values.

As soon as a trip in an elevator car is detected, movement, activity and/or characteristic patterns are compared to stored signal patterns and, based on the comparison, the stored signal patterns are adapted using the methods of machine learning. In doing so, the stored signal pattern is changed in the direction of the movement, activity and/or characteristic patterns detected before the trip.

Finally, it should be noted that terms such as "having," "comprising" and the like do not preclude other elements or steps, and terms such as "a" or "one" do not preclude a plurality. Furthermore, it should be noted that attributes or steps that have been described with reference to any one of the above embodiments may also be used in combination with other attributes or steps of other embodiments described above.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A method for detecting an entry into an elevator car of an elevator system by a passenger comprising the steps of:

detecting measured values using at least one sensor of a mobile device carried by the passenger during entry of the passenger into the elevator car, the at least one sensor being a rotational speed sensor;

evaluating the detected measured values with the mobile device to detect an instant of entry of the passenger into the elevator car based on the measured values;

wherein the measured values characterize movements of the passenger carrying the mobile device and represent rotational speeds; and generating information representing the instant of entry from the mobile device.

2. The method according to claim 1 wherein the mobile device detects and evaluates the measured values representing at least one of accelerations and magnetic fields.

3. The method according to claim 1 including deriving a movement pattern of the passenger from the measured values, comparing the movement pattern to at least one stored signal pattern, and detecting the instant of entry of the passenger into the elevator car based upon the comparison.

4. The method according to claim 1 including the mobile device detecting and evaluating characterizing activities of the elevator system using the at least one sensor.

5. A method for detecting an entry into an elevator car of an elevator system by a passenger comprising the steps of:

detecting measured values using at least one sensor of a mobile device carried by the passenger during entry of the passenger into the elevator car, the measured values representing movements of the passenger, and the at least one sensor being a rotational speed sensor;

evaluating the detected measured values with the mobile device to detect an instant of entry of the passenger into the elevator car based on the measured values; and generating information representing the instant of entry from the mobile device.

6. The method according to claim 5 wherein the mobile device detects and evaluates the measured values representing at least one of accelerations, rotational speeds and magnetic fields.

* * * * *